US007462276B2

(12) United States Patent
Wang et al.

(10) Patent No.: US 7,462,276 B2
(45) Date of Patent: Dec. 9, 2008

(54) TWO STAGE HYDROCRACKING PROCESS USING BETA ZEOLITE FOR PRODUCTION OF LPG AND DISTILLATE HYDROCARBONS

(75) Inventors: Li Wang, Bloomingdale, IL (US); Hemant B. Gala, Arlington Heights, IL (US); Christopher J. Anderle, Schaumburg, IL (US); Roger R. Lawrence, Elmhurst, IL (US)

(73) Assignee: UOP LLC, Des Plaines, IL (US)

( * ) Notice: Subject to any disclaimer, the term of this patent is extended or adjusted under 35 U.S.C. 154(b) by 231 days.

(21) Appl. No.: 11/612,622

(22) Filed: Dec. 19, 2006

(65) Prior Publication Data

US 2007/0084751 A1 Apr. 19, 2007

Related U.S. Application Data

(63) Continuation-in-part of application No. 10/749,336, filed on Dec. 31, 2003, now Pat. No. 7,169,291.

(51) Int. Cl.
*C10G 47/02* (2006.01)
*C10G 47/12* (2006.01)

(52) U.S. Cl. ..... 208/109; 208/111.3; 208/111.35; 208/108; 208/110

(58) Field of Classification Search ..... 208/109, 208/110, 111.3, 108, 111.35
See application file for complete search history.

(56) References Cited

U.S. PATENT DOCUMENTS 3,923,641 A 12/1975 Morrison ..... 208/111
4,486,296 A 12/1984 Oleck et al. ..... 208/111
4,612,108 A 9/1986 Angevine et al. ..... 208/111
4,661,239 A 4/1987 Steigleder ..... 208/111
4,740,292 A 4/1988 Chen et al. ..... 208/120
4,757,041 A 7/1988 Oleck et al. ..... 502/65
4,820,402 A 4/1989 Partridge et al. ..... 208/111
4,911,823 A 3/1990 Chen et al. ..... 208/67
4,925,546 A 5/1990 Kukes et al. ..... 208/111
4,983,273 A 1/1991 Kennedy et al. ..... 208/89
5,128,024 A 7/1992 LaPierre et al. ..... 208/89
5,160,033 A 11/1992 Vassilakis et al. ..... 208/111
5,192,727 A 3/1993 Nair et al. ..... 502/64

(Continued)

FOREIGN PATENT DOCUMENTS

EP 528494 B1 5/1995

(Continued)

OTHER PUBLICATIONS

Database WPI Section Ch, Week 200001 Derwent Publications Ltd., London, GB; AN 1999-348058 XP002237545 & JP 11 156198 A (China Petrochemical Corp), Jun. 15, 1999 abstract.

(Continued)

*Primary Examiner*—Tam M Nguyen
(74) *Attorney, Agent, or Firm*—James C Paschall

(57) ABSTRACT

Increased yields of LPG and middle distillate products are obtained in a two stage hydrocracking process by the use of a catalyst containing a beta zeolite. In embodiments, the beta zeolite has not been hydrothermally treated or has been hydrothermally treated at a relatively low temperature. In another embodiment, the catalyst contains a relatively low amount of beta zeolite.

21 Claims, 2 Drawing Sheets

U.S. PATENT DOCUMENTS

| | | | | |
|---|---|---|---|---|
| 5,228,979 | A | 7/1993 | Ward | 208/111 |
| 5,275,720 | A | 1/1994 | Ward | 208/111 |
| 5,279,726 | A | 1/1994 | Ward | 208/111 |
| 5,284,573 | A | 2/1994 | LaPierre et al. | 208/89 |
| 5,350,501 | A | 9/1994 | Ward | 208/111 |
| 5,358,917 | A | 10/1994 | Van Veen et al. | 502/66 |
| 5,384,296 | A | 1/1995 | Tsao | 502/66 |
| 5,609,752 | A | 3/1997 | Del Rossi et al. | 208/144 |
| 5,833,840 | A | 11/1998 | Absil et al. | 208/120 |
| 5,853,566 | A | 12/1998 | Kraushaar-Czarnetzki et al. | 208/109 |
| 5,866,744 | A | 2/1999 | Wu et al. | 585/486 |
| 6,190,538 | B1 | 2/2001 | Gosselink et al. | 208/111.01 |
| 6,231,750 | B1 | 5/2001 | Kasztelan et al. | 208/111.01 |
| 6,576,119 | B2 * | 6/2003 | Ishida et al. | 208/59 |
| 6,670,295 | B2 | 12/2003 | Wang et al. | 502/66 |
| 7,048,845 | B2 | 5/2006 | Bauer | 208/111.01 |
| 2002/0094931 | A1 | 7/2002 | Wang et al. | 502/63 |
| 2002/0112990 | A1 * | 8/2002 | Iaccino et al. | 208/210 |
| 2004/0045871 | A1 | 3/2004 | Bauer | 208/111.01 |
| 2004/0152587 | A1 | 8/2004 | Creyghton et al. | 502/64 |
| 2005/0197249 | A1 | 9/2005 | Creyghton et al. | 502/439 |
| 2006/0073963 | A1 | 4/2006 | Creyghton et al. | 502/64 |
| 2006/0175231 | A1 | 8/2006 | Hansen et al. | 208/120.01 |

FOREIGN PATENT DOCUMENTS

| | | | |
|---|---|---|---|
| EP | 955093 | A1 | 10/1999 |
| EP | 967014 | B1 | 3/2006 |
| JP | 11-156198 | | 6/1999 |
| WO | WO 2005/001000 | A1 | 1/2005 |
| WO | WO 2006/032698 | A1 | 3/2006 |

OTHER PUBLICATIONS

Ward, J.W. "Hydrocracking Processes and Catalysts" *Fuel Processing Technology*, 35 (1993) Elsevier Science Publishers B.V., Amsterdam pp. 55-85.

Bezman, R. "Relationship Between Zeolite Framework Composition and Hydrocracking Catalyst Performance" *Catalysis Today*, 13 (1992) Elsevier Science Publishers B.V., Amsterdam pp. 143-156.

* cited by examiner

TWO STAGE HYDROCRACKING PROCESS USING BETA ZEOLITE FOR PRODUCTION OF LPG AND DISTILLATE HYDROCARBONS

CROSS-REFERENCE TO RELATED APPLICATION

This application is a continuation-in-part of U.S. application Ser. No. 10/749,336, filed Dec. 31, 2003, the entire contents of which are hereby incorporated herein by reference.

FIELD OF THE INVENTION

The invention relates to a hydrocarbon conversion process referred to in the art as hydrocracking. The invention specifically relates to a hydrocracking process, which produces increased LPG boiling range and distillate boiling range products. The invention more specifically relates to a hydrocracking process, which employs a catalyst comprising a beta zeolite as an active cracking component.

BACKGROUND OF THE INVENTION

Hydrocracking is a basic conversion process used in many petroleum refineries worldwide to reduce the molecular weight of petroleum derived feedstocks and convert the feedstock into more valuable products such as motor fuel, diesel fuel and lubricants. Hydrocracking also has other beneficial results such as removing sulfur and nitrogen from the feedstock by hydrodesulfurization and hydrodenitrification.

Feedstocks most often subjected to hydrocracking are gas oils and heavy gas oils recovered from crude oil by distillation. A typical heavy gas oil comprises a substantial portion of hydrocarbon components boiling above about 371° C. (700° F.), usually at least about 50% by weight boiling above 371° C. (700° F.). The typical vacuum gas oil normally has a boiling point range between about 316° C. (600° F.) and about 566° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbonaceous products desired by the refiner. The operating conditions and the hydrocracking catalysts within a hydrocracking reactor influence the yield of the hydrocracked products.

A general review and classification of different hydrocracking process flow schemes and a description of hydrocracking catalysts is provided in the book titled *Hydrocracking Science and Technology*, by Julius Scherzer and A. J. Gruia published in 1996 by Marcel Dekker, Inc., New York, ISBN 0-8247-9760-4, especially at pages 174-183. FIGS. 10.2, 10.3 and 10.4 show hydrotreating reactors upstream of the hydrocracking reactor. As noted therein it is an established practice to first pass a hydrocracking unit feed stream into a hydrotreating reactor in order to reduce the level of sulfur and nitrogen tied up in the target petroleum molecules. Two hydrocracking reaction zones may be used in series with some form of intermediate separation between the hydrocracking zones to reduce the amount of hydrogen sulfide and product hydrocarbons carried over to the second hydrocracking zone with the hydrocarbon phase. This type of unit is normally referred to a two stage hydrocracking unit as shown by FIGS. 10.4 and 10.5.

While the overall physical design of a hydrocracking process can be very important to the level of conversion and selectivity achieved by a hydrocracking process, these two measures of performance are always also tied to the abilities of the hydrocracking catalyst employed in the process.

Hydrocracking catalysts are subject to initial classification on the basis of the nature of the predominant cracking component of the catalyst. This classification divides hydrocracking catalysts into those based upon an amorphous cracking component such as silica-alumina and those based upon a zeolitic cracking component such as Y zeolite. Hydrocracking catalysts are also subject to classification on the basis of their intended predominant product of which the three main products are liquefied petroleum gas (LPG), naphtha, and "distillate", a term which in the hydrocracking refining art refers to distillable petroleum derived fractions having a boiling point range which is above that of naphtha. Distillate typically includes the products recovered at a refinery as kerosene, diesel fuel, and aviation turbine fuel (ATF). LPG boiling range hydrocarbonaceous compounds typically contains $C_3$ and $C_4$ hydrocarbons, mostly propane and butane. The process disclosed herein relates to a zeolitic catalyst having improved selectivity for the production of distillate boiling range and LPG boiling range hydrocarbonaceous compounds. These catalysts normally comprise a zeolite component and a support or other component such as alumina or silica-alumina and a metal hydrogenation component.

It is known art to introduce nitrogen-containing streams, such as hydrocracking unit feedstocks or added ammonia, into the second stage of a two-stage hydrocracking unit to increase distillate selectivity. This and other changes in operating conditions allow the product distribution of an existing hydrocracking unit to be adjusted to a limited extent. However, the yield characteristics of the catalyst loaded in the unit are often of great importance in achieving a desired product distribution.

There is always a demand for new hydrocracking catalysts that provide lower costs, higher liquid product yields, and desired product streams. In some cases and in some parts of the world, it is highly desirable to produce maximum quantities of middle distillate including diesel and selective amounts of propane and butane for use as LPG. Processes for providing both of these two desirable product streams using the same or similar catalysts in the first and second stages of a two stage hydrocracking unit are sought.

RELATED ART

Zeolite beta has been proposed as a component of several different catalysts including catalysts for hydrocracking and hydrodewaxing. For instance, U.S. Pat. No. 3,923,641 issued to R. A. Morrison describes hydrocracking $C_5^+$ and $C_7^+$ naphthas to produce a high isobutane-normal butane ratio product using zeolite beta.

U.S. Pat. No. 4,612,108 issued to P. J. Angevine et al. describes a hydrocracking process which employs a catalyst comprising a beta zeolite. The catalyst is described as being effective in dewaxing of an unconverted portion of the charge stock and in partial conversion of the charge stock.

U.S. Pat. No. 4,757,041 issued to S. M. Oleck et al describes the simultaneous hydrocracking and dewaxing of heavy oils using a catalyst comprising zeolite beta plus a second zeolite such as X or Y zeolite.

U.S. Pat. No. 4,820,402 issued to R. D. Partridge et al. presents a hydrocracking process described as providing selectivity for the production of middle distillate range products. This increased selectivity is attributed to the use of a catalyst containing a highly siliceous large pore zeolite as the acidic component of a catalyst. Zeolite beta is indicated as being a suitable zeolite for this catalyst when it has a silica: alumina ratio of at least 50:1.

U.S. Pat. No. 4,983,273 issued to C. R. Kennedy et al. describes a hydrocracking process employing a catalyst based on zeolite beta. The process is described as providing several improvements due to unique process flows which include partial recycle of the liquid products. The beta zeolite preferably has a silica:alumina ratio greater than 30:1.

U.S. Pat. No. 5,228,979 describes a process for hydrocracking of hydrocarbon feedstocks in an ammonia rich environment using a catalyst comprising zeolite beta and a noble metal hydrogenation component, preferably palladium. This reference describes the silica:alumina ratio of the beta zeolite as being between 10 and 100 and preferably less than 40. There is also set out preferred water and cyclohexane adsorption capacities for the beta zeolite. These characteristics of the zeolite are described as providing a high activity hydrocracking catalyst.

U.S. Pat. Nos. 5,128,024 and 5,284,573 issued to R. B. LaPierre et al. describe hydrocarbon conversion processes in which heavy oils are simultaneously subjected to hydrocracking and dewaxing using a catalyst based upon zeolite beta with a hydrogenation component.

U.S. Pat. No. 6,190,538 B1 issued to J. W. Gosselink et al. describes the preparation of a catalyst which comprises zeolite beta as a first of two cracking components. The preferred beta is described as employed in the form of a small crystal having a silica:alumina ratio greater than 20 and preferably greater than 25 as for instance 120-150.

U.S. Pat. No. 6,231,750 B1 issued to S. Kasztelan et al. presents a hydrocracking catalyst comprising a matrix, a beta zeolite, a Group VB element and at least one mixed sulfide phase. The beta zeolite preferably has a silicon to alumina ratio of from 10 to 200 and more preferably of 10 to 150. It is indicated the beta zeolite can be dealuminated and should have a surface area greater than 400 square meters per gram.

Finally, Japanese unexamined patent publication published Jun. 15, 1999 based upon application 11-156198 describes a hydrocracking process for the production of middle distillates which employs a catalyst comprising beta zeolite and silica-alumina. The beta zeolite is dealuminated by acid treatment and then hydrothermally treated. The treated beta zeolite is characterized in terms of its total acidity, measured by pyridine adsorption, and adsorption capacity for water.

SUMMARY OF THE INVENTION

It has been discovered that a hydrocracking catalyst containing beta zeolite that has a silica:alumina molar ratio of less than 30:1 and a $SF_6$ adsorption capacity of at least 28 wt-% has good selectivity and activity in both stages of a two stage hydrocracking process to produce both middle distillate and LPG. The beta zeolite does not require steam treatment, although the beta zeolite can be steamed. The catalyst contains a metal hydrogenation component such as nickel, cobalt, tungsten, molybdenum, or any combination thereof.

This process greatly improves the efficiency and economic benefits of producing both desirable product streams. Surprisingly, the production of these two product streams having such widely diverse boiling ranges can be advantageously produced using a single catalyst in a single hydrocracking processing unit having two stages. It is believed that a two stage hydrocracking process using in both stages a hydrocracking catalyst containing the subject beta zeolite is novel to the art.

One embodiment of the process disclosed herein can be summarized as a two-stage hydrocracking process which comprises contacting a feed stream comprising hydrocarbonaceous compounds having boiling points between about 340° C. (664° F.) and about 565° C. (1049° F.) with a catalyst comprising a hydrogenation component and beta zeolite in the first stage. The hydrogenation component comprises a metal component such as nickel, cobalt, tungsten, molybdenum, or any combination. The beta zeolite has a silica:alumina molar ratio of less than 30:1 and a $SF_6$ adsorption capacity of at least 28 wt-%. The effluent of the first stage is separated to yield a liquid phase stream, the liquid phase stream is passed into a product fractionation zone producing a bottom stream containing unconverted feed components, and the bottom stream is passed to the second stage containing a catalyst comprising a hydrogenation component and beta zeolite such as those used in the catalyst in the first stage. Preferably, the catalysts used in the first and second stages have the same composition. The effluent of the second stage is separated to yield a liquid phase stream, which is passed into the product fractionation zone producing an LPG hydrocarbonaceous stream and a distillate hydrocarbonaceous stream.

DETAILED DESCRIPTION

Figure 1:
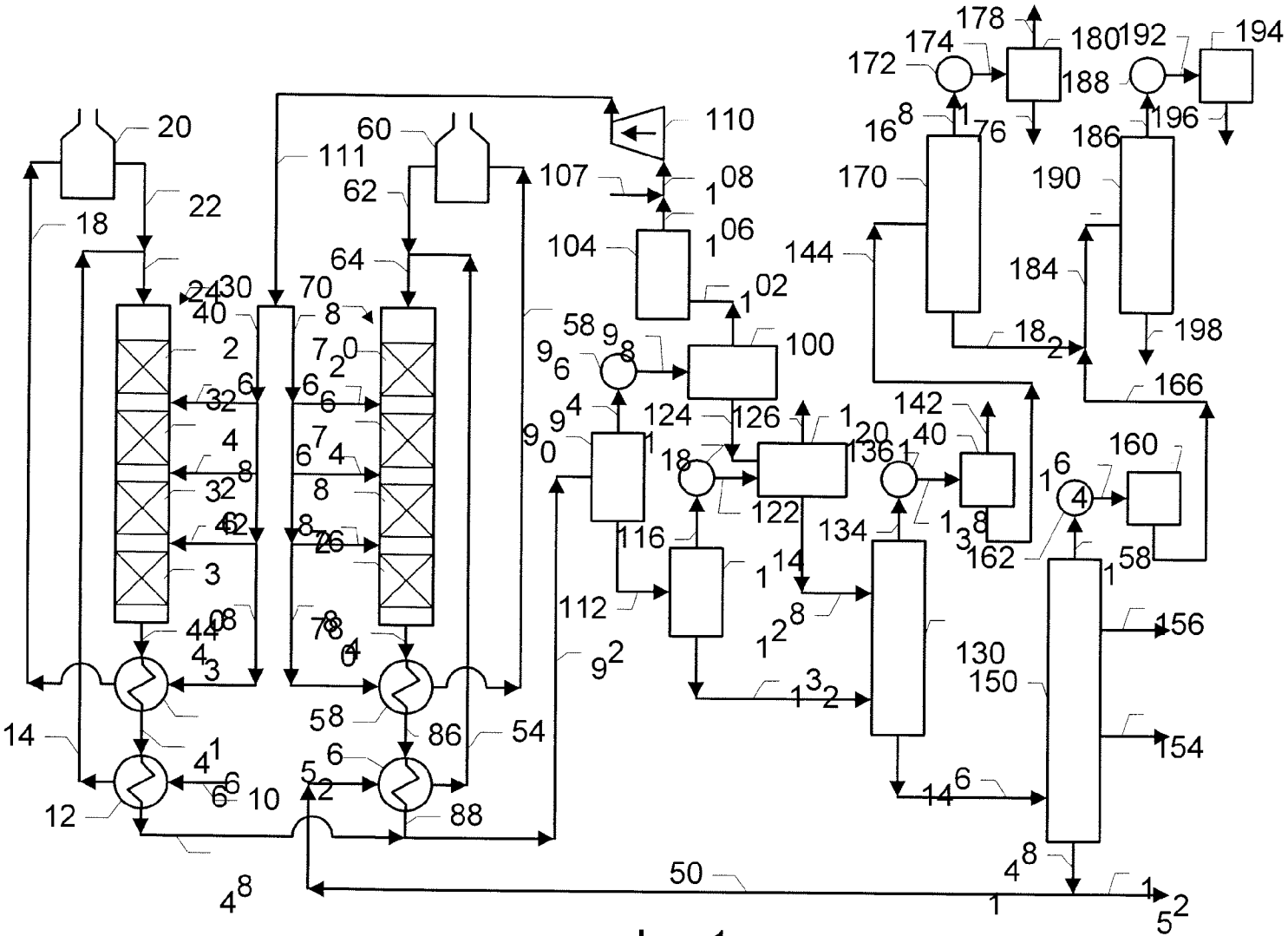
FIG. 1 is a schematic flow diagram illustrating the process of the present invention.

The relative values of the different products of a petroleum refinery are set by a variety of factors including local consumption patterns, and climate. In some locations there is a great economic advantage to producing naphtha boiling range hydrocarbonaceous compounds. In other locations there is a preference for producing the heavier (higher boiling) diesel and kerosene fractions as well as lighter (lower boiling) LPG fractions. While the product distribution from an existing hydrocracking unit can be adjusted to a limited extent by changes in feed stock and operation conditions, the yield characteristics of the catalyst used in the process are often of high if not determining importance. As the relative demand for distillate and LPG is increasing in some areas faster than the demand for naphtha boiling hydrocarbonaceous compounds, many refineries are attempting to increase their distillate and LPG production.

Therefore it is very important to refinery economics in some locations to avoid moderate conversion of the feedstock. Moderate cracking results in the production of larger percentages of undesired, lower value products such as naphtha. Lesser cracking results in the production of larger percentages of desired, higher value distillate, and greater cracking results in the production of larger percentages of desired, higher value $C_3$ and $C_4$ hydrocarbonaceous compounds, which are lighter than naphtha. Thus the selectivity of the hydrocracking process in producing the desired distillate and LPG products becomes very important. There is, therefore, a continuing economic advantage in providing catalysts and processes that are more selective. It is an objective of the process disclosed herein to provide an active hydrocracking catalyst and process which is selective for the production of both LPG boiling range hydrocarbonaceous compounds and distillate boiling range hydrocarbonaceous compounds.

As shown by the numerous references cited above, beta zeolite is well known in the art as a component of hydrocracking catalysts. Beta zeolite is described in U.S. Pat. No. 3,308,069 and Re No. 28,341, which are incorporated herein for their description of this material. The cited references also indicate that hydrocracking conditions and procedures are widely described in the literature. The zeolite beta that is used in the process disclosed herein has a silica:alumina molar ratio ($SiO_2$:$Al_2O_3$) of less than 30:1 in one embodiment, of less than 25:1 in another embodiment, of more than 9:1 and less than 30:1 in yet another embodiment, of more than 9:1 and less than 25:1 in a fourth embodiment, of more than 20:1 and less than 30:1 in a fifth embodiment, and of more than 15:1 and less than 25:1 in a sixth embodiment.

The beta zeolite is usually synthesized from a reaction mixture containing a templating agent. The use of templating agents for synthesizing beta zeolite is well known in the art. For example, U.S. Pat. No. 3,308,069 and Re No. 28,341 describe using tetraethylammonium hydroxide and U.S. Pat. No. 5,139,759, which is incorporated herein, describes using the tetraethylammonium ion derived from the corresponding tetraethylammonium halide. It is believed that the choice of a particular templating agent is not critical to the success of the process disclosed herein. In one embodiment the beta zeolite is calcined in air at a temperature of from 500 to 700° C. (932 to 1292° F.) for a time sufficient to remove to remove the templating agent from the beta zeolite. Calcination to remove the templating agent can be done before or after the beta zeolite is combined with the support and/or the hydrogenation component. Although it is believed that the templating agent could be removed at calcination temperatures above 700° C. (1292° F.), very high calcination temperatures could significantly decrease the $SF_6$ adsorption capacity of beta zeolite. For this reason it is believed that calcination temperatures above 750° C. (1382° F.) for removing the templating agent should be avoided when preparing the beta zeolite for use in the process disclosed herein. It is critical to the process disclosed herein that the $SF_6$ adsorption capacity of the beta zeolite is at least 28 wt-%.

Hydrothermally treating zeolites for use in hydrocracking catalysts is known. Nevertheless, steaming is a relatively blunt tool. For any given zeolite, steaming decreases the acidity of the zeolite. When the steamed zeolite is used as a hydrocracking catalyst, the apparent result is that the overall distillate yield increases but the LPG yield and the catalyst's activity decrease. This apparent tradeoff between the distillate yield, on the one hand, and LPG yield and activity, on the other hand, has meant that to achieve high activity and high LPG product yields means not to steam the zeolite, but at the expense of lower distillate product yields. This apparent tradeoff between overall yields and activity must be considered and is a limit to the improvement, which appears to be obtainable by steaming the zeolite. In comparison, the process disclosed herein is centered around using beta zeolite in hydrocracking catalyst in a manner which improves both activity and yields for LPG and middle distillate products.

The hydrocracking process disclosed herein centers on using relatively low amounts of a zeolite beta having a relatively low silica:alumina molar ratio and a relatively high $SF_6$ adsorption capacity. It has been found that differing performance results when such zeolite beta is incorporated in hydrocracking catalysts in this way. Not only is the activity of the hydrocracking catalyst higher than that of catalysts containing steamed beta zeolite, but unexpectedly the product yield is higher too.

The catalyst used in the process disclosed herein is intended primarily for use as a replacement catalyst in existing commercial hydrocracking units. Its size and shape is, therefore, preferably similar to those of conventional commercial catalysts. It is preferably manufactured in the form of a cylindrical extrudate having a diameter of from about 0.8-3.2 mm (1/32-1/8 in). The catalyst can however be made in any other desired form such as a sphere or pellet. The extrudate may be in forms other than a cylinder such as the form of a well-known trilobe or other shape which has advantages in terms or reduced diffusional distance or pressure drop.

Commercial hydrocracking catalysts contain a number of non-zeolitic materials. This is for several reasons such as particle strength, cost, porosity, and performance. The other catalyst components, therefore, make positive contributions to the overall catalyst even if not as active cracking components. These other components are referred to herein as the support. Some traditional components of the support such as silica-alumina normally make some contribution to the cracking capability of the catalyst. In one embodiment, the catalyst of the process disclosed herein contains a positive amount less than 15 percent beta zeolite by weight based on the combined weight of the beta zeolite and the support on a volatile-free basis. Volatile-free basis means the weight of each of the beta zeolite and the support is determined after each has been heated at 500° C. (932° F.) to drive off all volatile matter. Based on the combined weight of the beta zeolite and the support on a volatile-free basis, the zeolite content of the catalyst used in the process disclosed herein is a positive amount less than 3 wt-% in another embodiment, less than 2 wt-% in a third embodiment, less than 1.5 wt-% in a fourth embodiment, less than 1 wt-% in a fifth embodiment, less than 0.5 wt-% in a sixth embodiment, and from 0.1 to 2 wt-% in a seventh embodiment. The remainder of the catalyst particle besides the zeolitic material may be taken up primarily by conventional hydrocracking materials such as alumina and/or silica-alumina. The presence of silica-alumina helps achieve the desired performance characteristics of the catalyst. In one embodiment the catalyst contains at least 25 wt-% alumina and at least 25 wt-% silica-alumina based on the weight of the catalyst. In another embodiment, the silica-alumina content of the catalyst is above 40 wt-% and the alumina content of the catalyst is above 35 wt-%, both based on the weight of the catalyst. However, the alumina is believed to function only as a binder and to not be an active cracking component. The catalyst support may contain over 50 wt-% silica-alumina or over 50 wt-% alumina based on the weight of the support. Approximately equal amounts of silica-alumina and alumina are used in an embodiment. Other inorganic refractory materials which may be used as a support in addition to silica-alumina and alumina include for example silica, zirconia, titania, boria, and zirconia-alumina. These aforementioned support materials may be used alone or in any combination.

Besides the beta zeolite and other support materials, the subject catalyst contains a metallic hydrogenation component. The hydrogenation component is preferably provided as one or more base metals uniformly distributed in the catalyst particle. Noble metals such as platinum and palladium could be applied but best results have been obtained with a combination of two base metals. Specifically, either nickel or cobalt is paired with tungsten or molybdenum, respectively. The preferred composition of the metal hydrogenation component is both nickel and tungsten, with the amount by weight of the elemental metal of tungsten being about two to three times the amount of nickel. The amount of nickel or cobalt is preferably between about 2 and 8 weight percent of the finished catalyst. The amount of tungsten or molybdenum is preferably between about 8 and about 22 weight percent of the finished catalyst. The total amount of a base metal hydrogenation component is from about 10 to 30 weight percent.

The catalyst of the subject process can be formulated using industry standard techniques. This can, with great generalization, be summarized as admixing the beta zeolite with the other inorganic oxide components and a liquid such as water or a mild acid to form an extrudable dough followed by extrusion through a multihole die plate. The extrudate is collected and preferably calcined at high temperature to harden the extrudate. The extruded particles are then screened for size and the hydrogenation components are added as by dip impregnation or the well known incipient wetness technique. If the catalyst contains two metals in the hydrogenation component these may be added sequentially or simultaneously. The catalyst particles may be calcined between metal addition steps and again after the metals are added. The finished catalyst should have a surface area between about 300 and 550 $m^2/g$ and an average bulk density (ABD) of about 0.9 to 0.96 g/cc.

The typical feed to the subject process is a mixture of many different hydrocarbons and coboiling compounds recovered by fractional distillation from a crude petroleum. It will normally have a boiling point range starting above about 340° C. (644° F.) and ending in one embodiment below about 482° C. (900° F.), in another embodiment below about 540° C. (1004° F.), and in a third embodiment below about 565° C. (1049° F.). Such a petroleum derived feed may be a blend of streams produced in a refinery such as coker gas oil, straight run gas oil, deasphalted gas oil and vacuum gas oil. Alternatively, it can be a single fraction such as a heavy vacuum gas oil. Synthetic hydrocarbon mixtures such as recovered from shale oil or coal, or such as a Fischer-Tropsch wax, can also be processed in the subject process. The feed may be subjected to hydrotreating or treated as by solvent extraction prior to being passed into the subject process to remove gross amounts of sulfur, nitrogen or other contaminants such as asphaltenes. The subject process is expected to convert a large portion of the feed to more volatile hydrocarbonaceous compounds such as LPG and diesel boiling range hydrocarbonaceous compounds. Typical per-pass conversion rates in a stage of the hydrocracking reaction zone vary between about 30 and 95 vol-% depending greatly on the feed composition. The effluent of a stage of the process will actually contain a broad variety of hydrocarbonaceous compounds ranging from methane to essentially unchanged feed hydrocarbons boiling above the boiling range of any desired product. The hydrocarbons boiling above the boiling point of any desired product are referred to as unconverted products even if their boiling point has been reduced to some extent in the process. Most unconverted hydrocarbons are recycled to the hydrocracking reaction zone with a small percentage, e.g. 5 vol-%, being removed as a drag stream. With recycle of all unconverted material, essentially 100 vol-% overall conversion can be obtained, especially in a two-stage hydrocracking process.

The subject catalyst can be employed in what are referred to in the art as single stage and two stage process flows, with or without prior hydrotreating. These terms are used as defined and illustrated in the previously-mentioned book by Julius Scherzer and A. J. Gruia. In a two-stage process the subject catalyst can be employed in either the first or second stage. The catalyst may be preceded by a hydrotreating catalyst in a separate reactor or may be loaded into the same reactor as a hydrotreating catalyst or a different hydrocracking catalyst. An upstream hydrotreating catalyst can be employed as feed pretreatment step or to hydrotreat recycled unconverted materials. The hydrotreating catalyst can be employed for the specific purpose of hydrotreating polynuclear aromatic (PNA) compounds to promote their conversion in subsequent hydrocracking catalyst bed(s). The subject catalyst can also be employed in combination with a second, different catalyst, such as a catalyst based upon Y zeolite or having primarily amorphous cracking components.

The subject catalyst can also contain a Y zeolite. The term "Y zeolite" as used herein is meant to encompass all crystalline zeolites having either the essential X-ray powder diffraction pattern set forth in U.S. Pat. No.3,130,007 or a modified Y zeolite having an X-ray powder diffraction pattern similar to that of U.S. Pat. No. 3,130,007 but with the d-spacings shifted somewhat due, as those skilled in the art will realize, to cation exchanges, calcinations, etc., which are generally necessary to convert the Y zeolite into a catalytically active and stable form. The process disclosed herein requires a Y zeolite having either or both of the two properties mentioned above, such Y zeolites being modified Y zeolites in comparison to the Y zeolite taught in U.S. Pat. No.3,130,007. As used herein, unit cell size means the unit cell size as determined by X-ray powder diffraction. Preferably the amount of Y zeolite in the subject catalyst is less than the amount of beta in the subject catalyst, and preferably subject catalyst containing the Y zeolite is used in a stage operating at a relatively high per pass conversion, such as above about 70% or above about 90%. A preferred Y zeolite is prepared by the four-step procedure taught in U.S. Pat. No. 5,350,501, which is hereby incorporated herein by reference in its entirety. The Y zeolite produced by the four-step procedure in U.S. Pat. No. 5,350,501 is a UHP-Y zeolite, an ultrahydrophobic Y zeolite as defined in U.S. Pat. No. 5,350,501. The most preferred UHP-Y zeolite in U.S. Pat. No.5,350,501 is LZ-10 zeolite, which is a suitable Y zeolite for the subject catalyst. In addition, suitable Y zeolites for the subject catalyst include those prepared by the method described in U.S. Pat. No. 5,350,501, except with modifying the calcining conditions of the fourth treatment step in U.S. Pat. No. 5,350,501 so as to yield a unit cell size below 24.36 angstrom. The fourth step in U.S. Pat. No.5,350,501 involves calcining the resulting zeolite from the third treatment step in the presence of sufficient water vapor (in an atmosphere consisting essentially of steam or consisting of steam) so as to yield a unit cell size below 24.40, and most preferably no more than 24.35 angstrom, and with a relatively low sorptive capacity for water vapor. In addition, suitable Y zeolites for the subject catalyst include the Y zeolites that result from acid washing the Y zeolites prepared by the method described in U.S. Pat. No. 5,350,501 or from acid washing the Y zeolites prepared by the method described in U.S. Pat. No. 5,350,501 with the modified fourth treatment step. Such acid washing removes non-framework aluminum from the Y zeolite and can be done by methods known to persons of ordinary skill in the art.

In some embodiments of the process disclosed herein, the catalyst is employed with a feed or in a configuration that the feed passing through the catalyst is a raw feed or resembles a raw feed. The sulfur content of crude oil, and hence the feed to this process, varies greatly depending on its source. As used herein, a raw feed is intended to refer to a feed which has not been hydrotreated or which still contains organic sulfur compounds which result in a sulfur level above 1000 wt-ppm or which still contains organic nitrogen compounds that result in a nitrogen level above 100 wt-ppm (0.01 wt-%).

In other embodiments of the process disclosed herein, the catalyst is used with a feed that has been hydrotreated. Persons of ordinary skill in the art of hydrocarbon processing know and can practice hydrotreating of a raw feed to produce a hydrotreated feed to be charged to the process disclosed herein. Although the sulfur level of the feed may be between 500 and 1000 wt-ppm, the sulfur level of the hydrotreated feed is less than 500 wt-ppm in one embodiment of the process disclosed herein and from 5 to 500 wt-ppm in another embodiment. The nitrogen level of the hydrotreated feed is less than 100 wt-ppm in one embodiment and from 1 to 100wt-ppm in another embodiment.

While it is known that steaming a zeolite such as beta results in changes to the actual crystalline structure of the zeolite, the abilities of present day analytical technology have not made it possible to accurately monitor and/or characterize these changes in terms of important structural details of the zeolite. The situation is more complicated in the case of beta zeolite as compared to Y zeolite since there are nine different tetrahedral aluminum sites in beta zeolite but only one in Y zeolite. Instead, measurements of various physical properties of the zeolite such as surface area are used as indicators of changes that have occurred and the extent of the changes. For instance, it is believed that a reduction in the zeolite's capacity to adsorb sulfur hexafluoride ($SF_6$) after being steamed is believed to be caused by a reduction in the crystallinity of the zeolite or in the size or accessibility of the zeolite's micropores. It is, however, an indirect correlation of the changes in the zeolite that may be undesirable, since the $SF_6$ adsorption capacity in the catalyst used in the process disclosed herein is relatively high. In one embodiment of the process disclosed herein, the $SF_6$ adsorption capacity of the beta zeolite, whether steam treated or not, should be at least 28 wt-%.

Although in one embodiment of the process disclosed herein the beta zeolite has not been subjected to a steaming treatment, in other embodiments of the process disclosed herein the beta zeolite may be subjected to steaming, but the steaming is relatively mild in comparison to steaming of beta zeolite in the literature. Under the proper conditions and for the proper time, steaming zeolite beta has been found to yield a catalyst that can be used in the process disclosed herein. There is, as previously mentioned, an apparent tradeoff between overall distillate yield, on the one hand, and LPG yield and activity, on the other hand, that must be considered, and so there may be a limit to the improvement which appears to be obtainable by steaming the zeolite.

Steaming of the beta zeolite can be performed successfully in different ways, with the method which is actually employed commercially often being greatly influenced and perhaps dictated by the type and capability of the available equipment. Steaming can be performed with the zeolite retained as a fixed mass or with the zeolite being conveyed by means of a belt or being agitated in a rotating kiln. The important factors are uniform treatment of all zeolite particles under appropriate conditions of time, temperature and steam concentration. For instance, the zeolite should not be placed such that there is a significant difference in the amount of steam contacting the surface and the interior of the zeolite mass. In one embodiment, the beta zeolite is steam treated in an atmosphere having live steam passing through the equipment providing low steam concentration. This may be described as being at a steam concentration of a positive amount less than 50 mol-%. Steam concentrations may range from 1 to 20 mol-% in one embodiment and from 5 to 10 mol-% in another embodiment, with small-scale laboratory operations extending toward higher concentrations. The steaming in one embodiment is performed for a positive time period of less than or equal to 1 or 2 hours or for 1 to 2 hours at a temperature of less than or equal to about 600° C. (1112° F.) at atmospheric pressure and a positive content of steam of less than or equal to 5 mol-%. The steaming in another embodiment is performed for a positive time period of less than or equal to 2 hours at a temperature of less than or equal to about 650° C. (1202° F.) at atmospheric pressure and a positive content of steam of less than or equal to 10 mol-%. The steam contents are based on the weight of vapors contacting the zeolite beta. Steaming at temperatures above 650° C. (1202° F.) appears to result in zeolite that is not useful in the process disclosed herein since the $SF_6$ adsorption capacity of the resulting zeolite beta is too low. Temperatures below 650° C. (1202° F.) can be used, and the steaming temperature can be from about 600° C. (1112° F.) to about 650° C. (1202° F.) in one embodiment and less than 600° C. (1112° F.) in another embodiment. It is taught in the art that there is normally an interplay between time and temperature of steaming, with an increase in temperature reducing the required time. Nevertheless, if steaming is done, for good results it appears a time period of about ½ to 2 hours can be used in one embodiment and about 1 to 1½ hours in another embodiment. In one embodiment, the method of performing steaming on a commercial scale is by means of a rotary kiln having steam injected at a rate which maintains an atmosphere of about 10 mol-% steam.

The beta zeolite of the process disclosed herein is in one embodiment not treated with an acid solution to effect dealumination. In this regard it is noted that essentially all raw (as synthesized) zeolite is exposed to an acid to reduce the concentration of sodium which remains from synthesis. This step in the zeolite manufacture procedure is not considered part of the treatment of manufactured zeolite as described herein. In one embodiment, during the treatment and catalyst manufacturing procedures the zeolite is only exposed to an acid during incidental manufacturing activities such as peptization during forming or during metals impregnation. In one embodiment, the zeolite is not acid washed after the steaming procedure as to remove aluminum "debris" from the pores.

An exemplary lab scale steaming procedure is performed with the zeolite held in a 6.4 cm (2½ inch) quartz tube in a clam shell furnace. The temperature of the furnace is slowly ramped up by a controller. After the temperature of the zeolite reaches 150° C. (302° F.) steam generated from deionized water held in a flask is allowed to enter the bottom of the quartz tube and pass upward. Other gas can be passed into the tube to achieve the desired steam content. The flask is refilled as needed. In the exemplary procedure the time between cutting in the steam and the zeolite reaching 600° C. (1112° F.) was about one hour. At the end of the set steam period the temperature in the furnace is reduced by resetting the controller to 20° C. (68° F.). The furnace is allowed to cool to 400° C. (752° F.) (about 2 hours) and the flow of steam into the quartz tube is stopped. The sample is removed at 100° C. (212° F.) and placed in a lab oven held overnight at 110° C. (230° F.) with an air purge.

The beta zeolite of the process disclosed herein may also be characterized in terms of $SF_6$ adsorption. This is a recognized technique for the characterization of microporous materials such as zeolites. It is similar to other adsorption capacity measurements, such as water capacity, in that it uses weight differences to measure the amount of $SF_6$ which is adsorbed by a sample which has been pretreated to be substantially free of the adsorbate. $SF_6$ is used in this test since because of its size and shape hinders its entrance into pores having a diameter of less than about 6 Angstroms. It thus can be used as one measurement of available pore mouth and pore diameter shrinkage. This in turn is a measurement of the effect of steaming on the zeolite. In a simplistic description of this method, the sample is preferably predried in a vacuum at 350° C. (662° F.) and weighed. It is then exposed to the $SF_6$ for one hour while the sample is maintained at a temperature of 20° C. (68° F.). The vapor pressure of the $SF_6$ is maintained at that provided by liquid $SF_6$ at 400 Torr. The sample is again weighed to measure the amount of adsorbed $SF_6$. The sample may be suspended on a scale during these steps to facilitate these steps.

In any mass production procedure involving techniques such as steaming and heating there is a possibility for individual particles to be subjected to differing levels of treatment. For instance, particles on the bottom of a pile moving along a belt may not be subjected to the same atmosphere or temperature as the particles which cover the top of the pile. This factor must be considered during manufacturing and also during analysis and testing of the finished product. It is, therefore, recommended that any test measure done on the catalyst is performed on a number of randomly obtained individual pellets to avoid being misled by measurements which performed simultaneously on several particles. For instance, an adsorption capacity measurement made using several pellets reports the average adsorption of all the pellets and does not indicate whether individual particles match adsorption criteria. The average adsorption value could be within specification while the individual particles are not within the specification.

In accord with the process described herein, at least a portion of the feed is introduced into the first stage of a hydrocracking unit, along with added hydrogen. The admixture of hydrocarbonaceous compounds and hydrogen is heated in a heater and thereby brought up to the desired inlet temperature for the first stage. The first stage may contain one or more beds of hydrocracking catalyst containing the subject beta zeolite. The first stage and second stages of the subject hydrocracking process will be operated within the general range of conditions now employed commercially in hydrocracking processes. The operating conditions in many instances are refinery or processing unit specific. That is, they are dictated in large part by the construction and limitations of the existing hydrocracking unit, which normally cannot be changed without significant expense, the composition of the feed and the desired products. The inlet temperature of the catalyst beds in the first stage should be in the range of from about 232° C. (450° F.) to about 454° C. (850° F.), and the inlet pressure should be above about 6895 kPa(g) (1,000 psi(g)) and may often be from about 3448kPa(g) (500 psi(g)) to about 20685 kPa(g) (3000 psi(g)). The stream is admixed with sufficient hydrogen to provide a hydrogen circulation rate of from about 168 normal liters/liter (1000 standard cubic feet per barrel, hereinafter SCFB) to about 4211normal liters/liter (25000 SCFB) and often from about 337 normal liters/liter (2000SCFB) to about 1684 normal liters/liter (10000 SCFB) and passed into one or more first stage reactors containing fixed beds of the catalyst. The hydrogen will be primarily derived from a recycle gas stream which may pass through purification facilities for the removal of acid gases although this is not necessary. The hydrogen rich gas admixed with the feed and in one embodiment any recycle hydrocarbonaceous compounds will contain at least 90 mol percent hydrogen. The feed rate in terms of liquid hourly space velocity (LHSV) may be within the broad range of about 0.3 to about 30 $hr^{-1}$, but should normally be from about 0.5 to about 3 $hr^{-1}$ or from about 0.8 to about 2 $hr^{-1}$. Substantial conversion of the feed to lower boiling products occurs in the first stage. In accordance with the present invention, the term "substantial conversion to lower boiling products" is meant to connote the conversion of at least 5 volume percent of the fresh feed stock. In a preferred embodiment, the per pass conversion in the first hydrocracking zone is in the range from about 15 vol-% to about 75 vol-%. More preferably the per pass conversion is in the range from about 40 vol-% to about 70 vol-%.

There is thereby produced a first stage effluent stream which comprises an admixture of the remaining hydrogen which is not consumed in the reaction, light hydrocarbons such as methane, ethane, propane, butane, and pentane formed by the cracking of the feed hydrocarbonaceous compounds, and reaction by-products such as hydrogen sulfide and ammonia formed by hydrodesulfurization and hydrodenitrification reactions. The first stage effluent will contain the desired product hydrocarbonaceous compounds boiling in the LPG, diesel fuel, kerosene and/or ATF boiling point ranges. The first stage effluent will also contain hydrocarbonaceous compounds boiling in the naphtha, gasoline and/or fuel oil boiling point ranges and some unconverted feed hydrocarbonaceous compounds boiling above the boiling point ranges of the desired products. The effluent of the first stage will therefore comprise an extremely broad and varied mixture of individual compounds.

The first stage effluent is typically removed from contact with the catalyst bed, heat exchanged with the feed to the first stage for heat recovery and then passed into a vapor-liquid separation zone normally including at least one high pressure separator. Additional cooling can be done prior to this separation. In some instances a hot flash separator is used upstream of the high pressure separator. The use of "cold" separators to remove condensate from vapor removed from a hot separator is another option. Hydrogen-rich gases recovered from these vapor-liquid separations are preferably introduced to the first stage, and may also be introduced to the hydrotreating reactor or the second stage. Fresh makeup hydrogen may be introduced into the process at any suitable and convenient location. The liquids recovered in these vapor-liquid separation zones are passed into a product recovery zone containing one or more fractionation columns. Product recovery methods for hydrocracking are well known and conventional methods may be employed in the subject invention. The fractionation produced desired hydrocarbonaceous streams including an LPG boiling range stream and a distillate boiling range stream.

The conversion of process feed to products achieved in the first stage hydrocracking reactor(s) is not complete and some heavy hydrocarbonaceous compounds are removed from the product recovery zone as an "unconverted" or "drag" material removed from the product fractionation. When a common product fractionator is used to recover products in both the first and second stage effluents, a single stream containing a mixture of "unconverted" or "drag" material from both stages is recovered from the bottom portion of the common product fractionator. The size of such a single drag stream can be in the broad range of from about 30 to about 60 volume percent of the process feed stream. While classified as unconverted, this material has been subjected to considerable hydrogenation and desulfurization and therefore is normally of higher quality than the corresponding feed compounds. The cracking which occurs in the process will also change the relative composition of these heavy materials such that the harder to crack or more refractory compounds will be present at a higher concentration than in the feed. As used herein the term unconverted is intended to indicate compounds removed from the product fractionation zone as part of a stream having a boiling points above that desired in any of the product distillate streams. Unconverted materials may be recycled to the first stage.

In accord with the process disclosed herein some of the unconverted materials are passed to the second stage of the hydrocracking unit, with added hydrogen. The admixture of hydrocarbonaceous compounds and hydrogen is heated in a heater and thereby brought up to the desired inlet temperature for the second hydrocracking reaction zone. The second stage may contain one or more beds of hydrocracking catalyst containing the subject beta zeolite. The operating conditions of the second stage are within the ranges previously described for the first stage. However, the second stage generally operates at a lower temperature and a higher LHSV, normally from about 1 to about 3 $hr^{-1}$ or from about 1.5 to about 2.5 $hr^{-1}$. Substantial conversion of the feed to lower boiling products occurs in the second stage. In a preferred embodiment, the per pass conversion in the second hydrocracking zone is in the range from about 25 vol-% to about 75 vol-%. More preferably the per pass conversion is in the range from about 40 vol-% to about 70 vol-%. The per pass conversion of the first and second stages may be adjusted to achieve the desired selectivity to distillate boiling range hydrocarbonaceous compounds.

In order to produce more distillate boiling range hydrocarbonaceous compounds, an added nitrogen-containing stream may be introduced to the second stage. Suitable added nitrogen-containing streams include the feedstock prior to hydrotreating or streams containing ammonia or a precursor compound that reacts to form ammonia at the operating conditions of the second stage. The added nitrogen-containing stream may be introduced into the process at any suitable and convenient location. Without introducing added nitrogen to the second stage, the concentration of nitrogen in the feed to the second stage is generally less than 8 wt-ppm, and more typically less than 5 wt-ppm, based on the weight of hydrocarbonaceous compounds fed to the second stage. When added nitrogen is introduced to the second stage, the concentration of nitrogen in the feed to the second stage is generally from 10 wt-ppm to 100 wt-ppm, based on the weight of hydrocarbonaceous compounds fed to the second stage. Without being bound by a particular theory, it is believed that the nitrogen attenuates the acidity of catalytic sites of the second stage catalyst containing the subject beta zeolite, thereby suppressing cracking reactions and increasing the distillate selectivity.

The second stage effluent stream will contain, among other things, the desired product hydrocarbonaceous compounds boiling in the LPG, diesel fuel, kerosene and/or ATF boiling point ranges, and thus a broad and varied mixture of individual compounds. The second stage effluent is typically passed to at least one vapor-liquid separators and a product recovery zone containing at least fractionation column, similar to those described previously for processing the first stage effluent. The two effluents may pass to separate or common vapor-liquid separators and/or separate or common product recovery zones. Thus the vapor-liquid separators may be separate and the fractionation columns may be common. Where separate vapor-liquid separators are used, the hydrogen-rich gas recycled to the first stage can be kept isolated from the hydrogen-rich gas recycled to the second stage, and thus each recycle gas can have a different concentration of hydrogen, hydrogen sulfide, ammonia, and/or water. Depending on the arrangement of fractionation column(s) in the product recovery zone(s), multiple streams containing product LPG boiling range hydrocarbonaceous compounds, product distillate boiling range hydrocarbonaceous compounds, or unconverted material may be recovered, and similar streams may be combined. The conversion of second stage feed to products achieved in the second stage hydrocracking reactor(s) is not complete and some heavy hydrocarbonaceous compounds are removed from the product recovery zone as an "unconverted" or "drag" material removed from the product fractionation. Unconverted material recovered from the second stage may be recycled to the hydrotreating reactor, the first stage, or the second stage, with the second stage being preferred. Preferably, unconverted material recovered from both the first and second stages passes to the second stage.

In FIG. 1, the process of the present invention is illustrated by means of a schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to FIG. 1, a feed stream comprising vacuum gas oil is introduced into the process via line 10, is heated in exchanger 12, is transported via line 14, and admixed with a hydrogen-containing gaseous stream transported via line 22. The resulting admixture is transported via line 24 to reactor 30. Reactor 30 contains four catalyst beds, 32, 34, 36 and 38. These four catalyst beds are in a series flow arrangement with respect to the flow of feed stream components. Catalyst bed 32 is for a pretreating reaction zone containing hydrotreating catalyst. Catalyst beds 34, 36 and 38 are for a first stage of a two-stage hydrocracking unit, and contain catalyst containing the subject beta zeolite. The effluent of reactor 30 is transported via line 44, is cooled in exchanger 16, is transported via line 46, is cooled in exchanger 12, is transported via line 48, and is admixed with the effluent of reactor 70 transported via line 88. The admixture is transported via line 92 to hot separator 90. A liquid stream containing heavy, high boiling components is transported from hot separator 90 via line 112 to hot flash drum 114. A gaseous stream containing lighter boiling components and hydrogen is transported from hot separator 90 via line 94 and is cooled in exchanger 96. Wash water (not shown) may be introduced to the stream to control salt formation. The stream is transported via line 98 to cold separator 100. A hydrogen-rich gaseous stream is transported from cold separator 100 via line 102 to amine scrubber 104 to remove hydrogen sulfide ($H_2S$). The gaseous stream is contacted with a lean amine solution (not shown) and a rich amine solution (not shown) is removed from scrubber 104 and recovered. The scrubbed hydrogen-rich gaseous stream transported from scrubber 104 via line 106 is admixed with fresh makeup hydrogen introduced into the process via line 10, and the mixture is then introduced into compressor 110. A resulting compressed hydrogen-rich gaseous stream is transported via line 111, and is split by flow controllers so that portions are introduced into reactor 30 as quench upstream of beds 34, 36 and 38 via lines 26, 28 and 42, respectively, and into exchanger 16 via line 40. A hydrogen-rich gaseous stream is transported via line 18 to heater 20 and the resulting heated hydrogen-containing gaseous stream is transported via line 22.

Recycle oil from product fractionator distillation column 150 is transported via line 50, is heated in exchanger 52, is transported via line 54, and is admixed with a hydrogen-containing gaseous stream transported via line 62. The resulting admixture is transported via line 64 to reactor 70. Reactor 70 contains four catalyst beds, 72, 74, 76 and 78. These four catalyst beds are in a series flow arrangement with respect to the flow of hydrocarbonaceous components transported to the reactor 70 by line 64. Catalyst beds 72, 74, 76 and 78 are for a second stage of a two-stage hydrocracking unit, and contain catalyst containing the subject beta zeolite. The effluent of reactor 70 is transported via line 84, is cooled in exchanger 56, is transported via line 86, is cooled in exchanger 52, and is transported via line 88. The compressed hydrogen-rich gaseous stream transported via line 111 is split by flow controllers so that portions are introduced into reactor 70 as quench upstream of beds 74, 76 and 78 via lines 66, 68 and 82, respectively, and into exchanger 56 via line 80. A hydrogen-rich gaseous stream is transported via line 58 to heater 60 and the resulting heated hydrogen-containing gaseous stream is transported via line 62.

A liquid stream containing the lighter boiling components is transported from cold separator 100 via line 124 to cold flash drum 120. A water phase may be transported from cold separator 100 to cold flash drum 120 by a line not shown. A vapor stream is transported from hot flash drum 114 via line 116, is cooled in exchanger 118, and is transported via line 122 to cold flash drum 120. A vapor stream is transported from cold flash drum 120 via line 126 to conventional fuel gas facilities. A water phase may be transported from cold flash drum 114 to conventional sour water stripping facilities by a line not shown. A liquid stream is transported from cold flash drum 120 via line 128 to stripper distillation column 130. A liquid stream containing heavy, high boiling components is transported from hot flash drum 114 via line 132 to stripper 130.

Stripper 130 removes most and essentially all (more than 99%) of the hydrogen sulfide from the liquid streams transported from cold flash drum 120 and hot flash drum 114. An overhead stream is transported via line 134, is cooled in condenser 136, and is transported via line 138 to receiver 140. An LPG-containing gaseous stream is transported via line 142 to conventional gas treating facilities. A liquid stream containing liquid hydrocarbons is transported via line 144 to debutanizer distillation column 170. Debutanizer 170 stabilizes naphtha and recovers LPG from the liquid stream transported from stripper overhead receiver 140. An overhead stream is transported from debutanizer 170 via line 168, is cooled in condenser 172, and is transported via line 174 to receiver 180. An LPG-containing gaseous stream is transported via line 178 to conventional gas treating facilities. An LPG-containing liquid stream is transported via line 176 to conventional LPG processing facilities. A bottoms stream containing naphtha is transported via line 182 and is admixed with a stream containing naphtha transported via line 166. The admixture is transported via line 184 to naphtha splitter distillation column 190.

Product fractionator 150 separates the bottoms liquid stream from stripper 130 into naphtha, distillate products, and unconverted oil. The liquid stream is transported from stripper 130 via line 146 to product fractionator 150. A heater, not shown, heats the liquid stream prior to entering the product fractionator 150. An overhead stream containing naphtha is transported via line 158, is condensed in condenser 162, and is transported via line 164 to receiver 160. A naphtha-containing liquid stream is transported from receiver 160 via line 166. Kerosene and diesel sidecuts are transported from product fractionator 150 via lines 156 and 154, respectively. Kerosene and diesel sidecut strippers, not shown, may be used to meet fractionation specifications such as flash point, freeze point, pour point, and distillation gap of the kerosene and diesel sidecuts, respectively. An unconverted oil liquid stream containing little or no diesel is transported from fractionator 150 via line 148. The unconverted oil in line 148 is split so that one portion is transported to the second stage reactor 70 as recycle oil via line 50 and another portion is transported to conventional facilities for further processing via line 152. Naphtha splitter 190 separates the admixture transported in line 184, which may be heated by a heater not shown, into light and heavy naphtha products. An overhead stream is transported via line 186, is condensed in condenser 188, and is transported via line 192 to receiver 194. A liquid stream containing light naphtha is transported via line 196 to gasoline blending. A bottoms stream containing heavy naphtha is transported from naphtha splitter 190 to a conventional reforming unit via line 198.

To maximize the recovery of LPG components, the gaseous streams transported via lines 142 and 178 may be admixed and the admixture may be transported to an optional sponge absorber. The sponge absorber may be a gas-liquid contacting column preferably arranged for countercurrent contacting. The gaseous admixture may be contacted with a lean heavy naphtha liquid stream, such as a portion of that transported via line 198, and a rich heavy naphtha stream containing LPG components may be transported from the sponge absorber to debutanizer 170 to recover the absorbed LPG components.

The following examples are provided for illustrative purposes and not to limit the invention as defined in the claims.

EXAMPLE 1

Beta zeolite was obtained from a commercial source and was calcined in air for two hours at a temperature of 650° C. (1202° F.) to remove templating agent. After calcination, the beta zeolite had a silica:alumina molar ratio of 24.2:1 and the $SF_6$ adsorption capacity found in an analytical test of the beta zeolite was 29.3%. Catalyst A was prepared by mixing 0.5 parts by weight of beta zeolite, 48 parts by weight of silica-alumina, and 51.5 parts by weight of alumina in a muller to form a powder mixture. The parts by weight were determined on a volatile-free basis. The silica-alumina had a silica:alumina weight ratio of 78:22. An amount of water and nitric acid that was 4% of the powder mixture on a volatile-free basis was added to the powder mixture to form an extrudable dough. The dough was extruded to form 1/16"(1.6 mm) extrudate, which was calcined at 566° C. (1050° F.). The calcined extrudate was impregnated to incipient wetness with a solution containing $NiNO_3$ and ammonium metatungstate. The wet extrudate was dried and calcined at 510° C. (950° F.) using a belt calciner to form Catalyst A. Catalyst A contained 5.4% Ni and 17.8% W.

EXAMPLE 2

Catalyst B was prepared following the same procedure as that used for preparing Catalyst A, except that the powder mixture was formed by mixing 1 part by weight of beta zeolite, 47.8 parts by weight of silica-alumina, and 51.2 parts by weight of alumina.

EXAMPLE 3

Catalyst C was prepared following the same procedure as that used for preparing Catalyst A, except that the powder mixture was formed by mixing 3 parts by weight of beta zeolite, 46.5 parts by weight of silica-alumina, and 50.5 parts by weight of alumina.

EXAMPLE 4 (COMPARATIVE)

Four batches of the same commercial zeolite beta that was used as a starting material in the preparation of Catalyst A were each calcined to remove templating agent in the manner described in Example 1. Each batch was hydrothermally treated for 110 minutes. One batch was treated at a temperature of 725° C. (1337° F.), one batch was treated at a temperature of 880° C. (1616° F.), and two separate batches were treated at a temperature of 920° C. (1688° F.). The $SF_6$ adsorption capacity of the beta zeolite of each batch was measured, and the results are shown in Table 1.

TABLE 1

| Hydrothermal Treatment Temperature, ° C. | $SF_6$ Adsorption Capacity, wt-% |
|---|---|
| 725 | 26.8 |
| 880 | 17.1 |
| 920 | 12.7 and 13.3 |

EXAMPLE 5 (COMPARATIVE)

Five catalysts, Catalysts D-H, were prepared using as a starting material the same commercial beta zeolite that was used in the preparation of Catalyst A. The beta zeolite for each of Catalysts D-H was calcined to remove templating agent in the manner described in Example 1. During preparation of some of Catalysts D-H beta zeolite was hydrothermally treated at a temperature of 880° C. (1616° F.) for 110 minutes. During the preparation of the remaining Catalysts D-H beta zeolite was hydrothermally treated at a temperature of 920° C. (1688° F.). The amount of beta zeolite for each of Catalysts D-H was within the range of from 5 to 20 wt-% based on the combined weight of beta zeolite and support on a volatile-free basis. For each of Catalysts D-H, the $SF_6$ adsorption capacity of the beta zeolite used for each catalyst was within the range of from 12.7 to 17.1 wt-% following hydrothermal treatment.

EXAMPLE 6

The relative performances of Catalysts A-H were measured by pilot plant scale testing using a vacuum gas oil (VGO) having an API gravity of 22.48 and an end boiling point temperature by simulated distillation of 557° C. (1035° F.). The VGO contained 2.24 wt-% sulfur and 730 wt-ppm nitrogen. The catalysts were presulfided and subjected to a high space velocity in-use aging procedure prior to testing to ensure the test operation was free of startup artifacts. The temperature of the reaction zone during each test was controlled to result in the specified conversion to a collected liquid product at a L.H.S.V. of 1.0 $hr^{-1}$. The reaction zone was operated at a pressure of 14,479 kPa(g) (2100 psi(g)) with hydrogen being circulated at a rate of 1684 n.l/l (10,000 SCFB). Conversion during the testing periods varied between 50and 80 vol-%. Conversion was defined to be the yield of hydrocarbons boiling below 371° C. (700° F.) resulting from cracking of feed boiling above 371° C. (700° F.).

Figure 2:
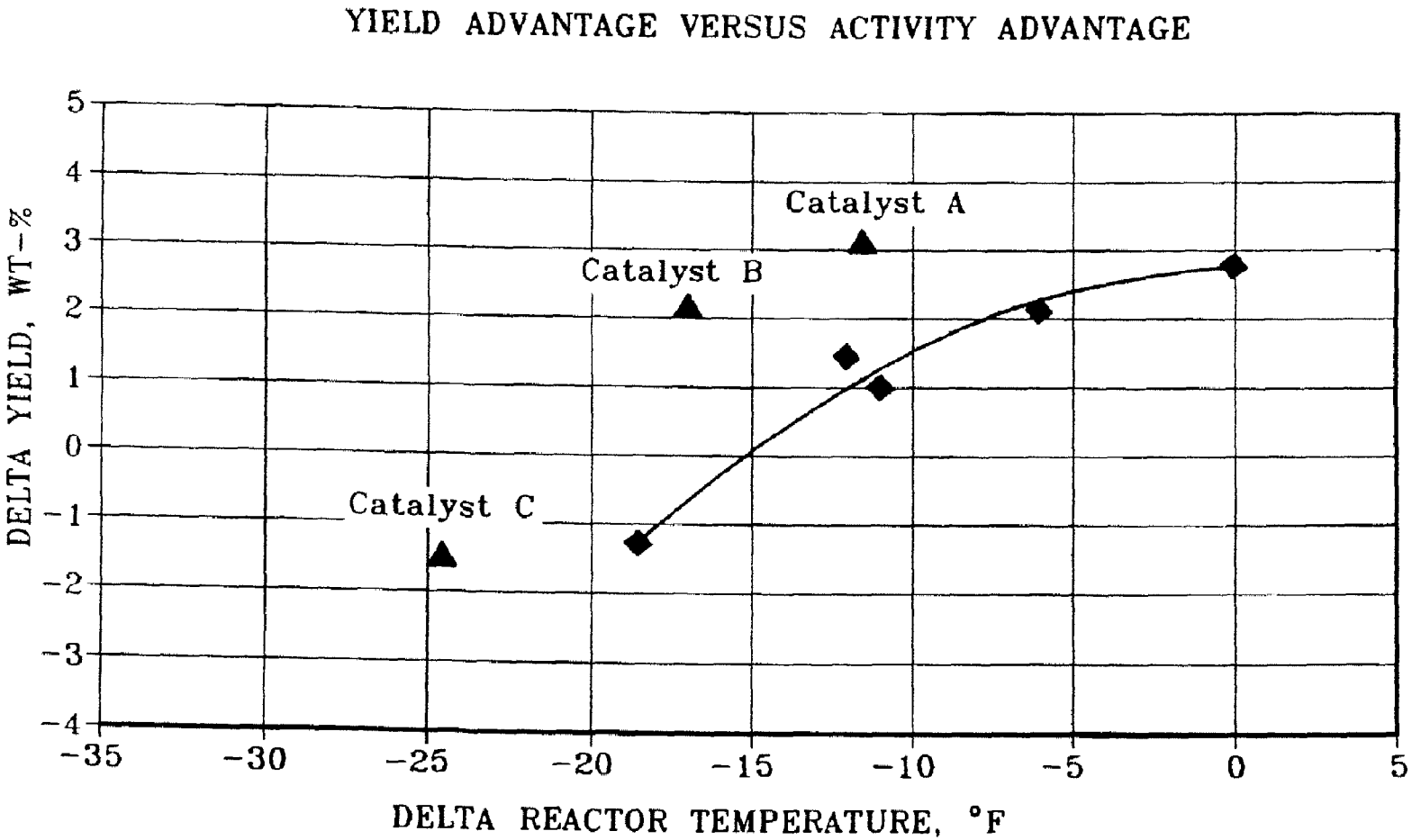
FIG. 2 is a chart of the yield advantage of tested catalysts compared to a reference catalyst plotted versus the activity advantage expressed in terms of reactor temperature compared to the reference catalyst.

FIG. 2 is a chart of the 149-371° C. (300-700° F.) cut distillate yield advantage of Catalysts A-H compared to a reference catalyst plotted versus the activity advantage compared to the reference catalyst also and expressed in terms of reactor temperature required to achieve 70% conversion of the VGO. Lower delta reactor temperature requirement indicates higher catalyst activity. The test results for Catalysts A, B, and C are shown in FIG. 2 as triangles that are labeled. The test results for Catalysts D-H are shown in the drawing as diamonds, and a smooth curve has been drawn through the diamonds.

Catalyst A showed a higher yield by about 2 wt-% than the curve for Catalysts D-H at a given delta temperature. Although a slight extrapolation of the curve for Catalysts D-H is required, Catalyst A also appeared to show a higher activity than the curve for Catalysts D-H at a given delta yield. Catalyst B showed a higher yield by about 2.5 wt-% than the curve for Catalysts D-H at a given delta temperature and a higher activity by about 5° C. (10° F.) than the curve for Catalysts D-H at a given delta yield. Although another slight extrapolation of the Catalysts D-H curve is must be done, Catalyst C appeared to show a higher yield than the curve for Catalysts D-H at a given delta temperature and a higher activity than the curve for Catalysts D-H at a given delta yield.

EXAMPLE 7

The process of the present invention is further demonstrated by the following illustrative embodiment. The data in this example were not obtained by the actual performance of the present invention but are considered prospective and reasonably illustrative of the expected performance of the invention.

A hydrocracker feedstock having the characteristics presented in Table 2 is hydrocracked in a hydrocracking unit such as shown in FIG. 1, except that reactor 30 does not have catalyst bed 38 and line 42, reactor 70 does not have catalyst bed 78 and line 82, and the "drag" stream in line 152 is small, intermittent, and may be considered negligible. The hydrocracking unit operates at the conditions presented in Table 3 to yield the products described in Table 4. Catalyst bed 32 contains a conventional hydrotreating catalyst (i.e., pretreating zone). Catalyst beds 34 and 36 (i.e., first stage) contain a catalyst that is prepared following a similar procedure as that used for preparing Catalyst A, except that the powder mixture is formed by mixing 0.6 part by weight of beta zeolite, 52.9 parts by weight of silica-alumina, and 46.5 parts by weight of alumina. Catalyst beds 72, 74, and 76 (i.e., second stage) use the same catalyst as catalyst beds 34 and 36. Reactor Distillation is measured using ASTM D1160, "Standard Test Method for Distillation of Petroleum Products at Reduced Pressure," ASTM International.

TABLE 2

| Hydrocracker Feedstock Analysis | |
|---|---|
| Gravity, °API at 15° C. (60° F.) | 29.3-27.5 |
| Specific Gravity at 15° C. (60° F.) | 0.88-0.89 |
| Distillation, Volume Percent | |
| IBP, ° C. (° F.) | 340 (644) |
| 10 | 400 (752) |
| 50 | 470 (878) |
| 90 | 540 (1004) |
| 98 | 580-585 (1076-1085) |
| Sulfur, weight-ppm | 5000 |
| Nitrogen, wt-ppm | 1200 |

TABLE 3

| Summary of Operating Conditions | |
|---|---|
| Reactor Operating Conditions | |
| Inlet Pressures of Reactors 30 and 70, kPa(g) (psi(g)) | 16181 (2347) |

TABLE 3-continued

| Summary of Operating Conditions | |
|---|---|
| Liquid Hourly Space Velocity, $hr^{-1}$ | |
| Catalyst bed 32 | 7.2 |
| Catalyst beds 34 and 36 | 2.7 |
| Catalyst beds 72, 74, and 76 | 1.6 |
| Average Bed Temperature, ° C. (° F.) | |
| Catalyst bed 32 | 402 (756) |
| Catalyst beds 34 and 36 | 409 (768) |
| Catalyst beds 72, 74, and 76 | 362 (684) |
| Second Stage Feed Nitrogen, wt-ppm | 2 |

TABLE 4

| Product Yields | |
|---|---|
| Product Yield, wt. % | |
| $NH_3$ | 0.2 |
| $H_2S$ | 0.5 |
| $C_1 + C_2$ | 0.6 |
| LPG | 4.1 |
| Total Naphtha | 15.4 |
| ATF/Kerosine | 47.1 |
| Diesel | 34.1 |
| Total | 102.0 |
| Total Distillate (121-383° C.) | 81.2 |
| Chemical $H_2$ Consumption | 2.0 |

From the above tables, it is apparent that the present invention is able to simultaneously and selectively produce LPG and distillate hydrocarbonaceous compounds from a heavy hydrocarbonaceous feedstock.

The foregoing description, drawings, and examples clearly illustrate the advantages encompassed by the process of the present invention and the benefits to be afforded with the use thereof.

The invention claimed is:

1. A two-stage hydrocracking process for the simultaneous production of distillate and LPG compounds having a first stage containing a first hydrocracking catalyst and a second stage containing a second hydrocracking catalyst, which process comprises contacting a feed stream comprising hydrocarbonaceous compounds having boiling points between about 340° C. and about 565° C. with catalyst, wherein at least one of the first hydrocracking catalyst and the second hydrocracking catalyst comprises a hydrogenation component and beta zeolite, which hydrogenation component comprises a metal component selected from the group consisting of nickel, cobalt, tungsten, molybdenum, and any combination thereof, which beta zeolite has a silica:alumina molar ratio of less than 30:1 and a $SF_6$ adsorption capacity of at least 28 wt-%.

2. The process of claim 1 further characterized in that at least one of the first hydrocracking catalyst and the second hydrocracking catalyst contains a support and contains a positive amount less than 3 wt-% beta zeolite based on the combined weight of the beta zeolite and the support in the at least one of the first hydrocracking catalyst and the second hydrocracking catalyst on a volatile-free basis.

3. The process of claim 2 wherein the silica:alumina molar ratio is more than 9:1 and less than 25:1.

4. The process of claim 2 wherein the support comprises a refractory inorganic oxide selected from the group consisting of alumina, silica-alumina, silica, zirconia, titania, boria, and zirconia-alumina, and any combination thereof.

5. The process of claim 1 further characterized in that the beta zeolite has not been treated by steaming to increase its selectivity to the production of middle distillate products prior to the contacting with the feed stream.

6. The process of claim 1 further characterized in that the beta zeolite has been treated by steaming at hydrothermal conditions comprising a temperature of less than or equal to 650° C. prior to the contacting with the feed stream.

7. The process of claim 6 wherein the hydrothermal conditions comprise a steam content of a positive amount less than or equal to 10 mol-% based on the weight of vapors contacting the zeolite beta and a time of a positive amount less than or equal to 2 hours.

8. The process of claim 1 wherein the first hydrocracking catalyst and the second hydrocracking catalyst have the same composition.

9. The process of claim 1 wherein at least one of the first hydrocracking catalyst and the second hydrocracking catalyst contains a Y zeolite.

10. A two-stage hydrocracking process for the simultaneous production of distillate and LPG compounds having a first stage containing a first hydrocracking catalyst and a second stage containing a second hydrocracking catalyst, which process comprises contacting a feed stream comprising hydrocarbonaceous compounds having boiling points between about 340° C. and about 565° C. with catalyst, wherein at least one of the first hydrocracking catalyst and the second hydrocracking catalyst comprises a hydrogenation component, a support, and beta zeolite, which beta zeolite has a silica:alumina molar ratio of less than 30:1 and a $SF_6$ adsorption capacity of at least 28 wt-%, which beta zeolite has not been treated by steaming prior to the contacting with the feed stream, which at least one of the first hydrocracking catalyst and the second hydrocracking catalyst contains a positive amount less than 1.5 wt-% beta zeolite based on the combined weight of the beta zeolite and the support in the at least one of the first hydrocracking catalyst and the second hydrocracking catalyst on a volatile-free basis.

11. The process of claim 10 wherein the silica:alumina molar ratio is more than 15:1 and less than 25:1.

12. The process of claim 10 wherein the at least one of the first hydrocracking catalyst and the second hydrocracking catalyst contains a positive amount less than 1 wt-% beta zeolite based on the combined weight of the beta zeolite and the support in the at least one of the first hydrocracking catalyst and the second hydrocracking catalyst on a volatile-free basis.

13. The process of claim 12 wherein the hydrogenation component comprises a metal component selected from the group consisting of nickel, cobalt, tungsten, molybdenum, and any combination thereof.

14. The process of claim 10 wherein the first hydrocracking catalyst and the second hydrocracking catalyst have the same composition.

15. A two stage hydrocracking process for the simultaneous production of LPG and distillate hydrocarbonaceous compounds, which process comprises:

a) passing hydrogen and a feed stream comprising hydrocarbonaceous compounds having boiling points between about 340° C. and about 565° C. into a first hydrocracking zone operated at first hydrocracking conditions and containing a first hydrocracking catalyst comprising a first hydrogenation component and a first beta zeolite, wherein the first hydrogenation component comprises a first metal component selected from the group consisting of nickel, cobalt, tungsten, molybdenum, and any combination thereof, wherein the first beta zeolite has a silica:alumina molar ratio of less than 30:1 and a $SF_6$ adsorption capacity of at least 28 wt-% and producing a first hydrocracking zone effluent stream comprising hydrogen, hydrogen sulfide, unconverted feed components, and product hydrocarbonaceous compounds;

b) separating at least a portion of the first hydrocracking zone effluent to yield a first vapor phase stream and a first liquid phase stream;

c) passing at least a portion of the liquid phase stream into a product fractionation zone producing a stream comprising LPG boiling range hydrocarbonaceous compounds, a stream comprising distillate hydrocarbonaceous compounds, and a bottoms stream comprising unconverted feed components;

d) passing at least a portion of the bottoms stream and hydrogen into a second hydrocracking zone operated at second hydrocracking conditions and containing a second hydrocracking catalyst comprising a second hydrogenation component and a second beta zeolite, wherein said second hydrogenation component comprises a metal component selected from the group consisting of nickel, cobalt, tungsten, molybdenum, and any combination thereof, wherein said second beta zeolite has a silica:alumina molar ratio of less than 30:1 and a $SF_6$ adsorption capacity of at least 28 wt-% and producing a second hydrocracking zone effluent stream; and e) separating at least a portion of the second hydrocracking zone effluent stream into a second vapor phase stream and a second liquid phase stream, and passing at least a portion of the second liquid phase stream into the product fractionation zone.

16. The process of claim 15 further characterized in that at least one of the first hydrocracking catalyst and the second hydrocracking catalyst contains a support and contains a positive amount less than 3 wt-% beta zeolite based on the combined weight of the beta zeolite and the support in the at least one of the first hydrocracking catalyst and the second hydrocracking catalyst on a volatile-free basis, and wherein the silica:alumina molar ratio of at least one of the first beta zeolite and the second beta zeolite is more than 9:1 and less than 25:1.

17. The process of claim 15 wherein the first hydrocracking catalyst and the second hydrocracking catalyst have the same composition.

18. The process of claim 15 comprising passing a portion of the feed stream into the second hydrocracking zone, wherein the portion of the feed stream passed into the second hydrocracking zone is selected to provide distillate boiling range hydrocarbonaceous compounds at a desired selectivity.

19. The process of claim 15 comprising introducing ammonia into the second hydrocracking zone, wherein the ammonia introduced into the second hydrocracking zone is introduced in an amount selected to provide distillate boiling range hydrocarbonaceous compounds at a desired selectivity.

20. The process of claim 15 wherein the first hydrocracking zone is operated at a first conversion per pass and the second hydrocracking zone is operated at a second conversion per pass, wherein the first and second conversions per pass are selected to provide distillate boiling range hydrocarbonaceous compounds at a desired selectivity.

21. The process of claim 15 wherein the first hydrocracking zone is operated at a conversion per pass in the range from about 15 vol-% to about 75 vol-%.

* * * * *